US006288327B1

(12) United States Patent
Tobias

(10) Patent No.: US 6,288,327 B1
(45) Date of Patent: Sep. 11, 2001

(54) GROUNDING DEVICE AND USE THEREOF IN TEMPORARY INSTALLATIONS

(75) Inventor: John M. Tobias, Toms River, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 08/452,107

(22) Filed: May 26, 1995

(51) Int. Cl.[7] ..... H01R 4/66
(52) U.S. Cl. ..... 174/6; 174/3; 174/5 SG
(58) Field of Search ..... 174/3, 2, 5 SG, 174/6; 191/13

(56) References Cited

U.S. PATENT DOCUMENTS 4,324,301 * 4/1982 Eyerly ..... 191/13 X

* cited by examiner

*Primary Examiner*—Albert W. Paladini

(74) *Attorney, Agent, or Firm*—Michael Zelenka; John M. O'Meara

(57) ABSTRACT

A grounding device for conducting current into the earth through protrusions which engage thereinto. The protrusions are integrally affixed on a base plate and extend from only one surface plane thereof. Protrusions having tapered configurations are included for compatibility with the surface and subsurface characteristics of the earth. Structural particulars regarding the base plate and the protrusions are also incorporated to enhance the bearing pressure between the protrusions and the earth. Such particulars may be incorporated to cause flexure in the grounding device that is employed under a wheel of a vehicle which is temporarily grounded therethrough and thereby enhance the bearing pressure.

18 Claims, 2 Drawing Sheets

GROUNDING DEVICE AND USE THEREOF IN TEMPORARY INSTALLATIONS

GOVERNMENT INTEREST

The invention described herein may be manufactured, used, and licensed by or for the United States Government for governmental purposes without payment to me of any royalties thereon.

BACKGROUND OF THE INVENTION

The present invention relates to a grounding device, particularly such a device for rapid employment in a temporary installation.

Grounding devices for conducting current into the earth are well known in the art. For permanent installations having water or sewer pipes, various types of clamps can be used on such pipes to provide a low resistance ground. Such pipes are not usually installed for temporary installations and therefore other types of grounding devices must be utilized.

Well known temporary grounding devices fall into two general categories, those that make subsurface contact with the earth and those that make surface contact with the earth. Of the subsurface types, the simplest and best known is the metal stake which is driven into the earth. The peripheral size of the stake and the subsurface characteristics of the earth at the particular grounding location, determine the depth to which the stake must be driven. A wire buried in a shallow ditch constitutes another subsurface type. The ditch is plowed into the earth and the length thereof is determined by the diameter of the wire and the subsurface characteristics of the earth at the particular grounding location. Of the surface types, the simplest is a mat of interwoven wire, which generally conforms to the contour of the earth's surface when disposed thereon. The area of the mat is determined by the weave mesh thereof and the surface characteristics of the earth at the particular grounding location. To improve the mats electrical contact with the earth's surface, metal pegs are driven into the earth to press parts of the mat there-against. In another surface type, a wire is disposed on the earth and held thereagainst with metal pegs that are driven thereinto. The length of the wire is determined mostly by the surface characteristics of the earth at the particular grounding location and the number of pegs utilized.

Of course, use of either a surface or subsurface type of grounding device requires time which is a precious commodity in urgent situations, such as the establishment of a temporary military installation in the field.

SUMMARY OF THE INVENTION

It is the general object of the present invention to conduct current into the earth through a grounding device that is quickly employed and unemployed.

It is a specific object of the present invention to sustain a bearing pressure against the earth when employing a grounding device in accordance with the general object.

It is more specific object of the present invention to utilize a grounding device in accordance with the general object for grounding a motor vehicle with which the device is employed.

These and other objects are accomplished in accordance with the present invention, by structuring the grounding device to have a plurality of electrically conductive protrusions integrally affixed to and extending from one side of an electrically conductive base plate. In many preferred embodiments, the protrusions are tapered to have conical or wedge configurations. When practical, the protrusion taper is in accordance with both the surface and subsurface characteristics of the earth at the location where current is to be conducted thereinto. Many preferred embodiments also sustain a bearing pressure between the protrusions and the earth, which enhances electrical conductivity therebetween. Various structural aspects may be incorporated into the base plate to provided a flexure therein which enhances the sustained bearing pressure. For a particular embodiment, the grounding device is employed by driving a motor vehicle thereover in a temporary grounding system for the vehicle.

The scope of the present invention is only limited by the appended claims for which support is predicated on the preferred embodiments hereafter set forth in the following description and the attached drawings.

DESCRIPTION OF THE PREFERRED EMBODIMENTS

Figure 1:
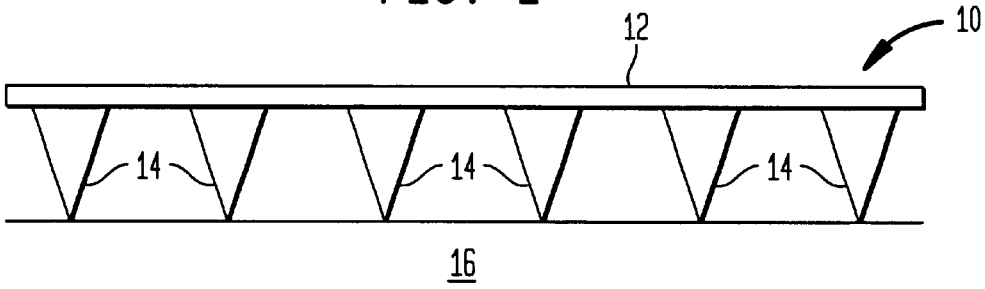
FIG. 1 is a side view of a grounding device in accordance with the invention.
Figure 2:
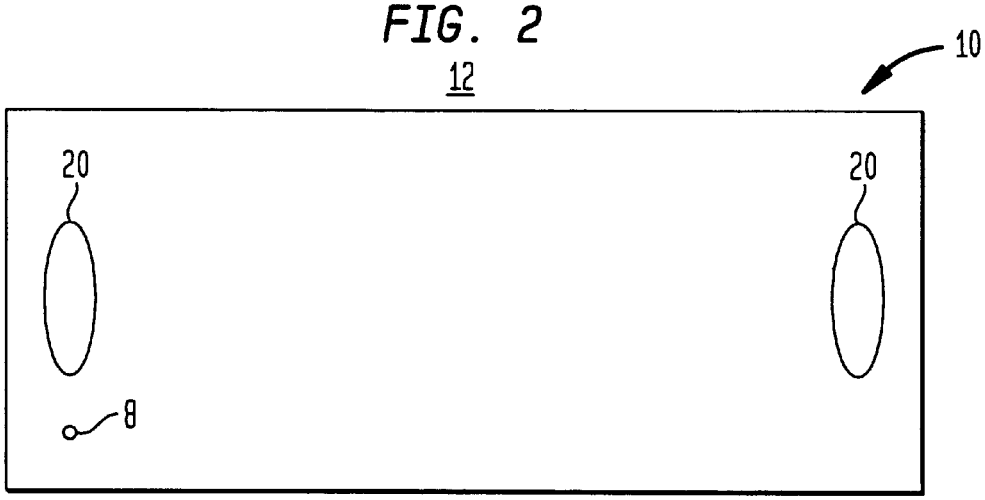
FIG. 2 is the top view of the FIG. 1 grounding device.

Of fundamental importance to the present invention is a grounding device 10 for conducting current into the earth. As shown in FIG. 1 grounding device 10 includes an electrically conductive base plate 12 and a plurality of electrically conductive protrusions 14 which extend from only one side of the plate 12 and are integrally affixed thereto. When employing the grounding device 10, it is disposed to stand with the protrusions 14 against the surface of the earth 16 and force is applied against the plate 12 in the direction of the earth 16 to engage the protrusions 14 thereinto. When the grounding device 10 has been employed, plate 12 is located across the surface of the earth 16 as shown in FIG. 2 and the items to be grounded therethrough are electrically interconnected thereto, such as at a lug terminal 18. Handles 20 for manipulating the grounding device 10 are provided on the plate 12, such as with oval apertures therethrough.

Although the protrusions 14 could be of many different configurations, a configuration which provides a taper to facilitate employment of the grounding device 10, is desirable. If the surface and subsurface characteristics of the earth 16 are known at the location where a ground is to be provided, the taper slope should be in accordance therewith. For hard or crusted surfaces and compact or dense subsurfaces, the angle of the taper relative to the earth 16 should be larger than for granular or soft surfaces and loose or damp subsurfaces. Either conical or wedge configurations could be utilized to derive the taper shown in FIG. 1. Both the plate 12 and protrusions 14 may be fabricated of any electrically conductive material, such as steel. Each protrusion 14 is integrally affixed to the plate 12 using conventional techniques such as a pin knockout design or a weld. As will be understood without further explanation by those skilled in the electrical arts, the resistance encountered through the grounding device 10 to the earth 16 depends on the number of protrusions 14 utilized on the device 10, as well as the pattern of and spacing between those protrusions 14. Although many combinations of these factors are possible to derive the desired resistance, all of these factors should be considered for each particular application of the grounding device 10.

Figure 3:
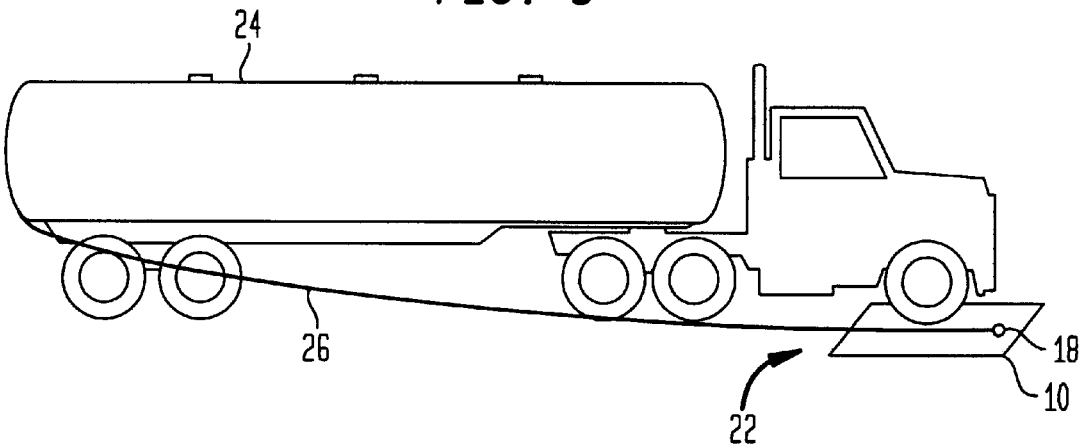
FIG. 3 is an isometric view of the grounding device being employed in a temporary grounding system for a motor vehicle.

Any convenient method for applying force to the plate 12 can be utilized when the grounding device 10 is employed. So long as the area of the earth 16 covered by the plate is not too large, a sledge hammer can be utilized. Also, penetration of the protrusions 14 into the earth could be started with a sledge hammer and completed in some other manner, such as driving a vehicle over the plate 12. One particular application for this technique is in a temporary grounding system 22, such as illustrated in FIG. 3 for a motor vehicle 24. In modern warfare, field vehicles 24 that remain in one location too long are detected and often destroyed. Therefore, temporary grounding system 22 includes the grounding device 10 which can be rapidly employed and unemployed. Whenever vehicle 24 must be grounded for purposes such as lightning protection, communications or power generation, the grounding device 10 is first employed. Then the chassis of the vehicle 24 is electrically connected to the grounding device 10, such as through a wire or cable 26 which is sized in accordance with the amount of current to be conducted into the earth 16. Before vehicle 24 is moved to another location, the cable 26 is first disconnected and then grounding device 10 is unemployed by lifting its plate 12 to disengage its protrusions 14 from the earth 16.

Figure 4:
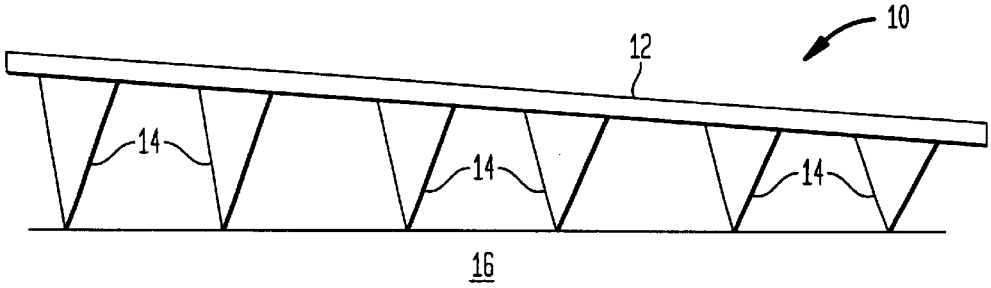
FIG. 4 is a side view of another grounding device in accordance with the invention.
Figure 5:
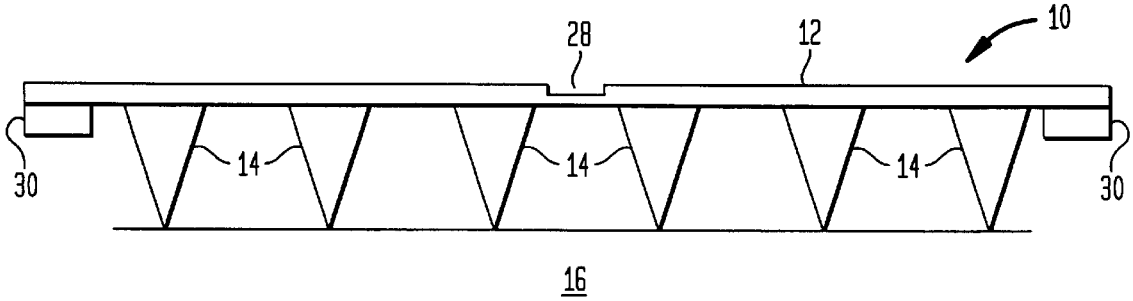
FIG. 5 is a side view of still another grounding device in accordance with the invention.

Electrical conductivity from the grounding device 10 to the earth 16 can be enhanced by augmenting the bearing pressure therebetween. This is accomplished in FIG. 3 by keeping the weight of the vehicle 24 on the grounding device 10 after it has been employed. The grounding device 10 can also be structured to augment that bearing pressure, as shown in FIGS. 4 and 5. Of primary significance in FIG. 4, the protrusions 14 are disposed at an angle relative to the plane of the plate 12. Consequently, when the protrusions 14 are engaged into the earth 16 with the plate 12 disposed parallel to the surface thereof, an increased bearing pressure develops on the acute angle side of the protrusions 14. As also shown in FIG. 4, the protrusions 14 may be of increasing length from one end of the plate 12 to the other, so that the grounding device 10 will sit like a ramp on the surface of the earth 16 to facilitate employment thereof with the vehicle 24. In FIG. 5, the grounding device 10 is structured so that the plate 12 thereof will sustain a flexure therein when employed as shown in FIG. 3. Because of this flexure, an increased bearing pressure develops on one side of each protrusion 14. Although the grounding devices 10 in FIGS. 1 and 5 resemble each other, at least one groove 28 across the surface of plate 12 from which the protrusions 14 do not extend and/or at least one raised bearing surface 30 across the surface thereof from which the protrusions 14 do extend, are only provided in the grounding device 10 of FIG. 5.

Those skilled in the art will appreciate without any further explanation that within the concept of this invention many modifications and variations are possible to the above disclosed embodiments of the grounding device 10. Consequently, it should be understood that all such variations and modifications fall within the scope of the following claims.

What I claim is:

1. A grounding device for conducting current into the earth, comprising:

one electrically conductive base plate; and a plurality of electrically conductive protrusions integrally affixed to the plate and extending from only one side thereof;

the device providing a ground for items electrically connected thereto when the protrusions thereon are engaged into the earth.

2. The grounding device of claim 1 wherein the protrusions are tapered.

3. The grounding device of claim 2 wherein the tapered configuration of the protrusions is in accordance with both the surface and subsurface characteristics of the earth at the location where ground is to be provided.

4. The grounding device of claim 3 wherein the protrusions have a conical configuration.

5. The grounding device of claim 3 wherein the protrusions have a wedge configuration.

6. The grounding device of claim 1 wherein structural means is included for augmenting the bearing pressure between the protrusions and the earth when the grounding device is employed.

7. The grounding device of claim 6 wherein the structural means includes the protrusions being disposed at an angle relative to the plane of the plate.

8. The grounding device of claim 6 wherein the structural means includes at least one groove in the plate on the side thereof having no protrusions extending therefrom.

9. The grounding device of claim 6 wherein the structural means includes at least one raised bearing surface on the side of the plate from which the protrusions extend.

10. A temporary grounding system for a vehicle, comprising:

at least one grounding device for conducting current into the earth, each grounding device having one electrically conductive base plate on which a plurality of electrically conductive protrusions are integrally affixed to extend from one side thereof; and means for electrically connecting the vehicle to each grounding device after the protrusions thereon have been engaged into the earth by locating each grounding device under one wheel of the vehicle.

11. The grounding system of claim 10 wherein the protrusions are tapered.

12. The grounding system of claim 11 wherein the tapered configuration of the protrusions is in accordance with both the surface and subsurface characteristics of the earth at the location where ground is to be provided.

13. The grounding system of claim 12 wherein the protrusions have a conical configuration.

14. The grounding system of claim 12 wherein the protrusions have a wedge configuration.

15. The grounding system of claim 10 wherein structural means is included for augmenting the bearing pressure between the protrusions and the earth when the grounding device is employed.

16. The grounding system of claim 15 wherein the structural means includes the protrusions being disposed at an angle relative to the plane of the plate.

17. The grounding system of claim 15 wherein the structural means includes at least one groove in the plate on the side thereof having no protrusions extending therefrom.

18. The grounding system of claim 15 wherein the structural means includes at least one raised bearing surface on the side of the plate from which the protrusions extend.

* * * * *